US006182303B1

(12) United States Patent
Gardenier et al.

(10) Patent No.: US 6,182,303 B1
(45) Date of Patent: Feb. 6, 2001

(54) MULTIPLE SLOT FLUID FLOW

(75) Inventors: W. John Gardenier; John V. Maiuccoro, both of Albany, NY (US)

(73) Assignee: Saratoga Spa & Bath Co., Inc., Latham, NY (US)

( * ) Notice: Under 35 U.S.C. 154(b), the term of this patent shall be extended for 0 days.

(21) Appl. No.: 09/464,111

(22) Filed: Dec. 16, 1999

(51) Int. Cl.[7] ..... A61H 33/04
(52) U.S. Cl. ..... 4/541.6; 4/541.1; 4/541.3
(58) Field of Search ..... 4/541.2, 541.3, 4/541.4, 542.5, 541.6, 492, 490, 567, 568, 570; 239/549, 423, 433, 556, 548, 587.4

(56) References Cited

U.S. PATENT DOCUMENTS 4,520,514 * 6/1985 Johnson ..... 4/490
4,764,999 * 8/1988 Rushing ..... 4/542
4,896,384 * 1/1990 Dijkhuizen ..... 4/542
4,953,240 * 9/1990 Gardenier ..... 4/541
5,065,942 * 11/1991 Shannon ..... 239/423
5,682,625 * 11/1997 Leaverton et al. ..... 4/541.1

* cited by examiner

*Primary Examiner*—Henry J Recla
*Assistant Examiner*—Khou Huynh
(74) *Attorney, Agent, or Firm*—Heslin & Rothenberg, P.C.

(57) ABSTRACT

Hydrotherapy-tub multiple slot flow device includes slotted outlets on a body for discharge of fluids from a nozzle in a substantially coplanar flow and in a selected direction. The body is adapted for mounting on an inner surface of a hydrotherapy tub and attachable to first and second fluid supply conduits. Further, the body has a first inlet for flow of a fluid from the first fluid supply conduit and a second inlet for flow of a fluid from the second fluid supply conduit.

8 Claims, 6 Drawing Sheets

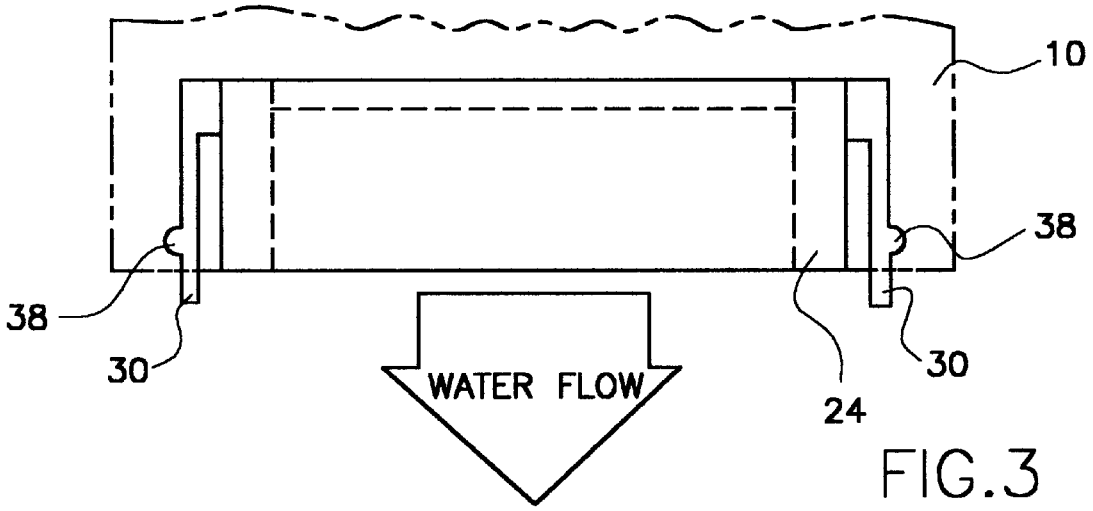
FIG.3
FIG.4
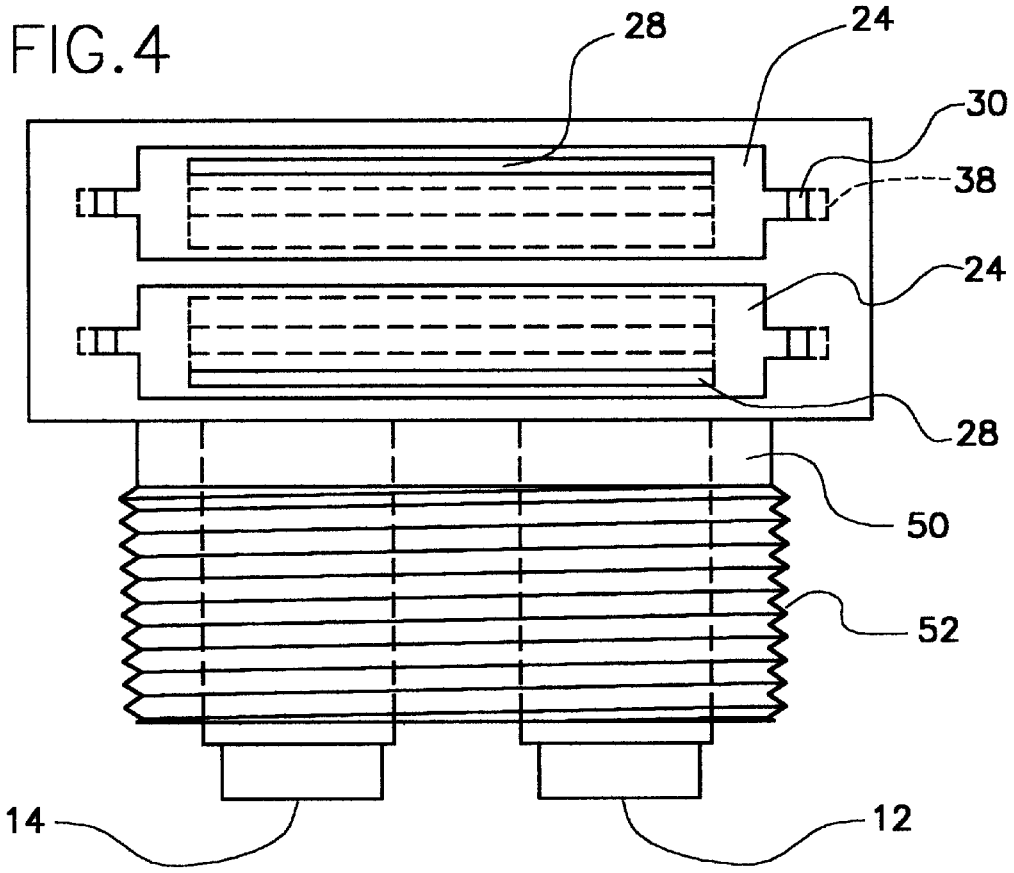

MULTIPLE SLOT FLUID FLOW

TECHNICAL FIELD

This invention relates, in general, to hydrotherapy tubs and, in particular, to fluid flow devices usable for creating fluid flow in hydrotherapy tubs.

BACKGROUND ART

Hydrotherapy tubs, spa assemblies and like systems have enjoyed increased popularity in recent years. In the majority of such systems, a contained space is at least partially filled with a fluid, such as water, which continuously is circulated throughout the contained space. A fluid directing structure is provided to include one or more jet streams of water directed into the interior of the contained space to create a certain amount of water turbulence.

In a conventional spa assembly or system, the tub or pool like structure is generally formed of rigid material and permanently mounted or fixed either in ground or above ground at a specific location. Fixed plumbing in the form of rigid material conduits, pumps, heating structures, etc. are then mounted at this given location in communication with the interior of the rigid material tub or pool to create the desired treatment of water being circulated. Hydrotherapy tubs generally have a number of fluid flow outlets or nozzles. Each flow nozzle usually jets water or a water-air froth into the tub. Enhanced hydrotherapy typically results from strategic positioning of these fluid flow nozzles at various locations in the tub. The one or more flow nozzles located throughout the tub generally direct streams of water to specific locations of the user which aids in hydrotherapy of that location.

Some fluid flow nozzles have the user controlled ability to direct a single jet stream of water into multiple positions, by rotating or pivoting the fluid flow nozzle. However, providing hydrotherapy to multiple areas at the same time, is limited by the number and placement of the fluid flow nozzles. In general these nozzles have been placed in specific locations by the manufacturer and cannot be relocated without significant work and expense. Therefore, if a user wishes to provide hydrotherapy to two or more locations at the same time, there may be difficultly due to nozzle placement.

Thus, a need exists for enhanced strategic directioning of the fluid flow paths thereby enabling a user to direct fluid, from a single outlet, to more than one location at the same time.

SUMMARY OF THE INVENTION

The shortcomings of the prior art are overcome and additional advantages are provided through an improved hydrotherapy-tub multiple slot fluid-flow device. A hydrotherapy-tub fluid flow device, comprises a body adapted for mounting on an inner surface of a hydrotherapy tub and attachable to first and second fluid supply conduits, the body may have a first inlet for flow of a fluid from a first fluid supply conduit, a second inlet for flow of a fluid from a second fluid supply conduit, and a first outlet for discharge of the first fluid in a first direction; and a second outlet for discharge of the second fluid in a second direction, with the second direction being different from the first direction.

A fluid flow device of this type has a number of advantages. A removable nozzle or nozzles may be fastened to the body about the outlet(s). The nozzles are advantageous for selectively directing fluid flow from the device, thereby aiding in enhanced hydrotherapy. The nozzles allow fluid to be directed from a single device, simultaneously, in different directions. This allows a user to perform hydrotherapy on different body parts at the same time, or on different locations of the same body part at the same time.

Additional features and advantages are realized through the structures and techniques of the present invention. Other embodiments and aspects of the invention are described in detail herein.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention will be apparent from the following detailed description of preferred embodiments taken in conjunction with the accompanying drawings in which:

FIG. 3 is a partial top view of one example hydrotherapy-tub two slot fluid-flow device in accordance with the principles of the present invention;

FIG. 4 is a front elevational view of a hydrotherapy-tub two slot fluid-flow device in accordance with the principles of the present invention;

DESCRIPTION OF THE PREFERRED EMBODIMENTS

In accordance with the principles of the present invention, multiple slot fluid flow capability with selective directional flow is provided for a hydrotherapy-tub by using a fluid flow device in which flow channels may discharge fluids from multiple nozzles in substantially coplanar flow as well as in a selected directional flow, as described below. The present invention contains subject matter related to commonly owned U.S. patent application Ser. No. 09/253,476, which is hereby incorporated by reference.

Figure 1:
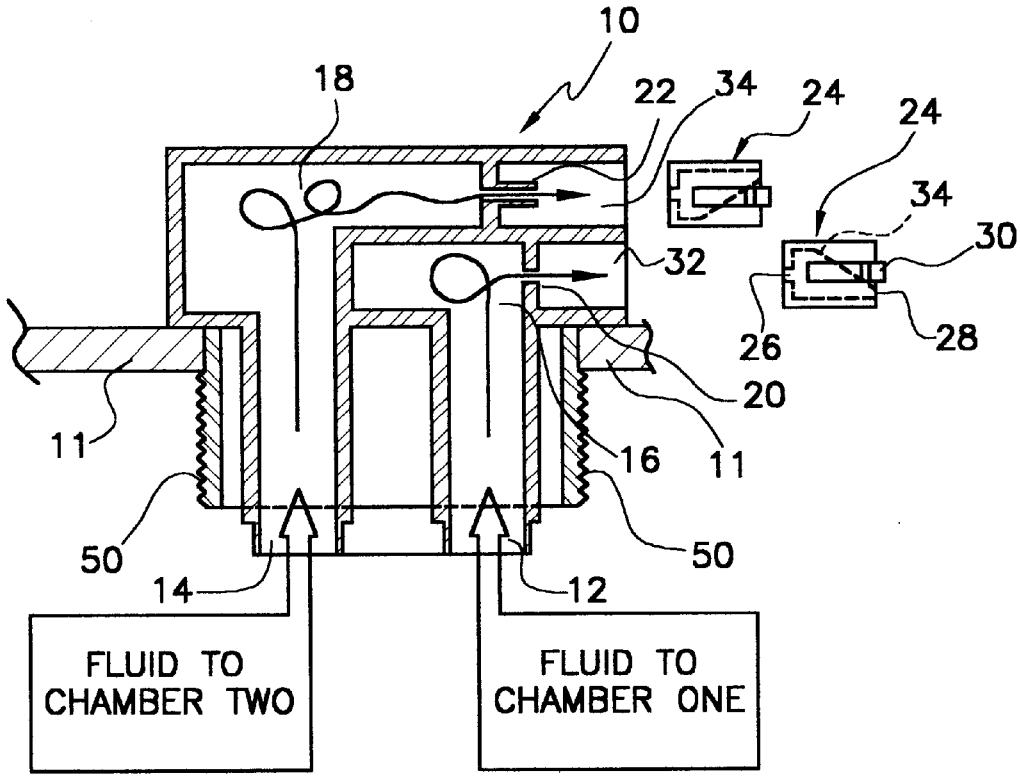
FIG. 1 is a side sectional view of one example of a hydrotherapy-tub two slot fluid-flow device.

One example of a hydrotherapy-tub fluid flow device incorporating and using the novel features of the present invention is depicted in FIG. 1 and described in detail herein.

In this exemplary embodiment, a fluid flow device 10 may be mounted onto a hydrotherapy tub wall 11. Fluid flow device 10 comprises a pair of inlets 12 and 14 which are fluidly connected to a first chamber 16 and a second chamber 18 respectively. First chamber 16 has an outlet 20, and second chamber 18 has an outlet 22. Inlet 12 may be fluidly connected to a first fluid supply conduit (not shown), and inlet 14 may be fluidly connected to a second fluid supply conduit (not shown). The fluid supply conduits feed fluids (e.g., water and/or air) to fluid flow device 10. Preferably, the fluid supply conduits deliver a fluid, to fluid flow device 10, under pressure. The fluid flow transition from the fluid supply conduits, through inlets 12 and 14, and into flow first chamber 16 and second chamber 18, for eventual discharge from outlets 20 and 22 may advantageously serve to promote fluid delivery from the fluid supply conduits and into substantially coplanar flow, as well as selective directional flow. A decreased cross-sectional area, for flow of the pressurized fluid, formed by outlets 20 and 22 yields increased flow velocity of the fluid as it exits the fluid flow device. This increased stream velocity of the fluid provides fluid flow strong enough to provide sufficient hydrotherapy effects. Various aspects of the invention related to such flow features, system dynamics, and/or hydrodynamics, will be appreciated by those skilled in the art.

Directional flow of fluid from fluid flow device 10 may be controlled by the use of a removable nozzle 24. Nozzle 24 comprises an inlet 26 an outlet slot 28 and a fastening member 30. Nozzle 24 is configured such that it may be snapped into a respective housing 32 and/or housing 34 of fluid flow device 10, such that inlet 26 of nozzle 24 is aligned to receive fluid from outlets 20 or 22, respectively. Nozzle 24 may have a tapered portion of an inner wall 34, which directs the fluid to outlet slot 28.

Figure 2:
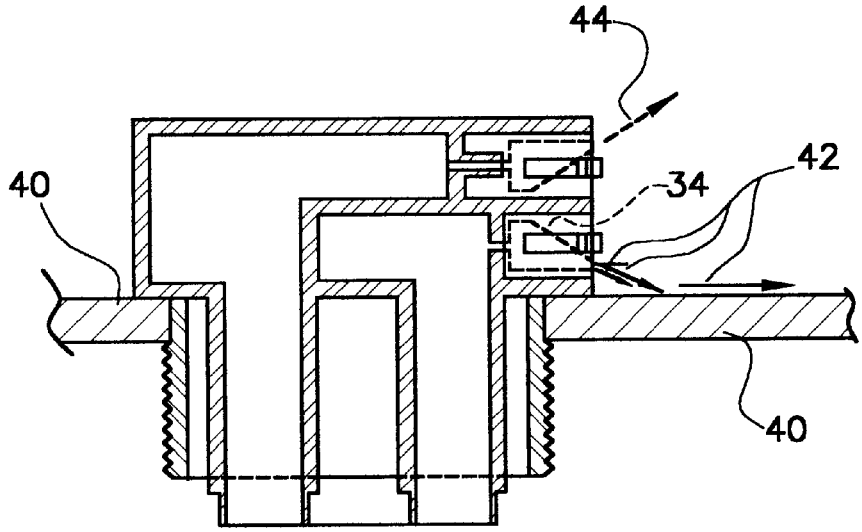
FIG. 2 is a side sectional view of one example of a hydrotherapy-tub two slot fluid-flow device with nozzle inserts in accordance with the principles of the present invention.

As shown in FIG. 2, placement of nozzles 24 within their respective housing of fluid flow device 10 allows a user to select the direction of fluid flow. The tapered portion of inner wall 34 of nozzles 24 directs fluid from the outlet slot 28 in the direction of arrows 42 and 44. In this example the user has selected to create a substantially coplanar flow 42 along with an angular flow 44. The term coplanar flow as used in the context of this invention, refers to the flow of a fluid along the inner surface of the tub or hydrotherapy spa, in substantially the same plane as the inner surface. Other selective directional flow schemes may be created by varying the angle of the tapered portion of inner wall 34. Similarly, nozzles 24 may be placed in their housing in multiple directional flow configurations.

As shown in FIG. 3, nozzle 24 is placed within housing 32 of fluid flow device 10. Nozzle 24 has a pair of fastening members 30 which may be snapped into housing 32, and held in place by a pair of engagement members 38. The use of fastening members 30 allows easy placement and/or removal of nozzle 24. Fastening members 30 may be configured so that nozzle 24 may be inserted into housing 32 in either direction, thereby allowing a single nozzle design to direct fluid in multiple directions depending on its orientation within housing 32.

FIG. 4 illustrates a fluid flow device 10 having a pair of nozzles 24 inserted therein. The user has selected to insert each nozzle 24 in a different orientation with one having an outlet slot 28 on the bottom in the other having the outlet slot 28 on the top. This allows fluid to flow in a substantially coplanar direction, in relation to the tub inner wall, as well in an angular direction to affect hydrotherapy on various locations of the user. Nozzle 24 may also have various configurations of the outlet slot 28.

Figure 5:
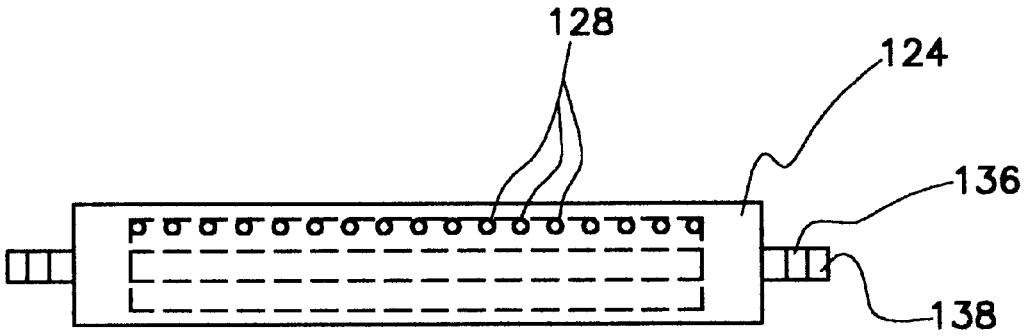
FIG. 5 is a front elevational view of a hydrotherapy-tub two slot fluid-flow device insert in accordance with the principles of the present invention.

An alternative embodiment of nozzle 24 is shown in FIG. 5 as nozzle 124. Nozzle 124 as a pair of engagement members 136 and a protruding member 138 for fastening within the housing of a fluid flow device. Nozzle 124 also has a plurality of outlet holes 128 which provide a plurality of fluid streams. Outlet holes 128 may vary in size and shape to produce the desired fluid stream and sensation required. The fluid streams may provide a different sensation to the user which may aid in hydrotherapy.

Figure 6:
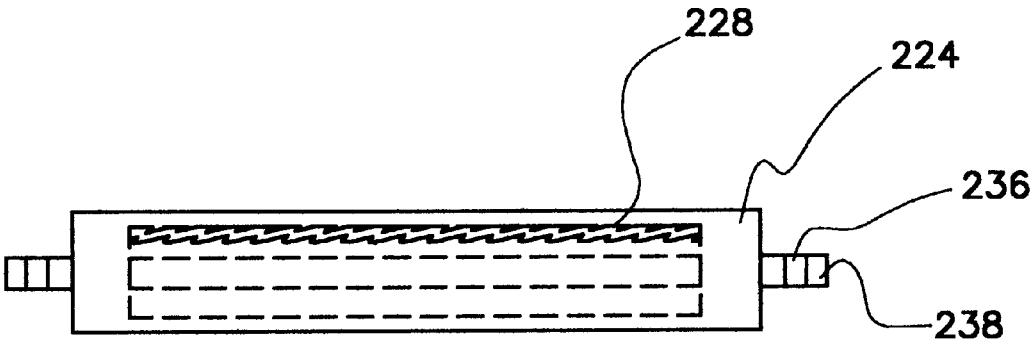
FIG. 6 is a front elevational view of an alternative embodiment of a hydrotherapy-tub two slot fluid-flow device insert in accordance with the principles of the present invention.
Figure 7:
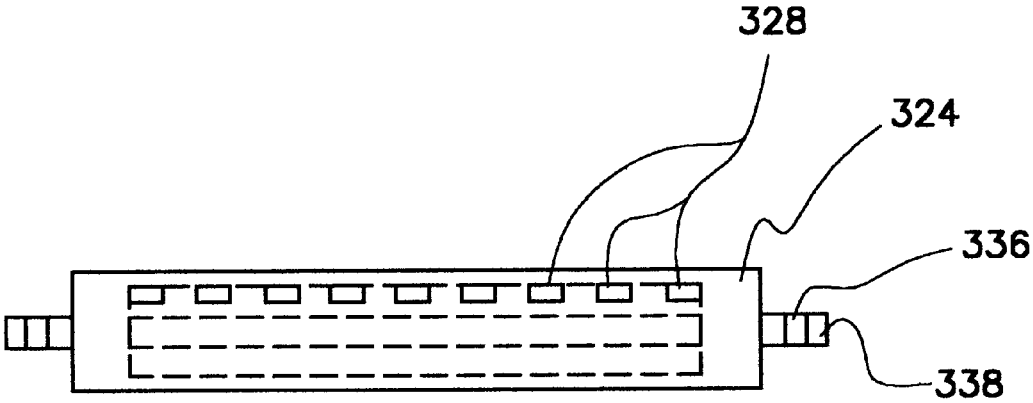
FIG. 7 is a front elevational view of an alternative embodiment of a hydrotherapy-tub two slot fluid-flow device insert in accordance with the principles of the present invention.

An alternative embodiment of nozzle 24 is shown in FIG. 6 as nozzle 224. Nozzle 224 as a pair of engagement members 236 and a protruding member 238 for fastening within the housing of a fluid flow device. Nozzle 224 also has a diagonally "zig-zag" shaped outlet slot may provide a unique fluid flow to the user. The size and shape of outlet slot 228 may vary depending on the specific needs of the user. The fluid streams may provide a different sensation to the user which may aid in hydrotherapy.

An alternative embodiment of nozzle 24 is shown in FIG. 6 as nozzle 324. Nozzle 324 as a pair of engagement members 336 and a protruding member 338 for fastening within the housing of a fluid flow device. Nozzle 324 also has a plurality of rectangular outlet holes 328 which provide a plurality of fluid streams. Outlet holes 328 may vary in size and shape to produce the desired fluid stream and sensation required. The fluid streams may provide a different sensation to the user which may aid in hydrotherapy.

Referring to FIG. 1 for explanatory purposes, fluid is delivered from the fluid supply conduits, through inlets 12 and 14, and into flow chambers 16 and 18. For fluid transmission, the fluid supply conduits may be a typical hose or tube leading from a (e.g., 13–14 p.s.i.) pump (not shown) housed within or nearby the hydrotherapy tub. The pump would provide sufficient pressure for the formation of fluid flow. For example, the pump may provide a water flow of 13 g.p.m. The pump typically would receive the fluid from within the tub and re-circulate the same into the tub after pumping the fluid through one or more fluid flow devices 10. Furthermore, the user may advantageously adjust the pressure and/or amount of fluid delivered through the fluid supply conduits to fluid flow device 10. As will be understood by those skilled in the art, various devices may be used for flow adjustment and controls therefor may appear in various locations.

By allowing the user to adjust the flow characteristics in one or more of the various fluid supply conduits, as desired, in conjunction with the configuration of flow paths, the present invention advantageously permits the user to select direction and/or delivery rates of fluids, for improved hydrotherapy through control over the fluid flow.

In accordance with the present invention, the hydrotherapy-tub fluid-flow device may be mounted on the hydrotherapy tub in a variety of ways. FIG. 2 depicts the body of the coplanar-flow device largely embedded within hydrotherapy tub wall 40. The outlet nozzle may desirably aim fluid flow along relative direction 42, approximately parallel to the inner surface, as well as a direction 44 as selected by a user.

In a further example, referring to FIG. 1, coil clamps may be used to secure the fluid supply conduits to respective inlets 12 and 14. Also, epoxy and/or glue may be employed or other such suitable adhesive as may be known in the art.

In particular, inlets 12 and 14 maintain secure fluid communication with respective their fluid supply conduits. For example, each inlet may possess a number of integrally formed barbs and upon sliding insertion of each inlet into one of the fluid supply conduits, the barbs provide local points of highly increased static friction. Further, one may tighten clamps around the fluid supply conduits at a location encircling the barbs in order to strengthen attachment of the inlets and fluid supply conduits. These measures yield securely sealed communication of fluid from the fluid supply conduits through inlets 12 and 14.

Furthermore, fluid-flow device 10 may include sidewalls 50 surrounding inlets 12 and 14. For instance, the sidewalls may include exterior threads 52 for mating with a nut (not shown)in order to securely position the device on the tub wall 40.

In one example, the device 10 is mounted to the inner surface 40 of a hydrotherapy tub using epoxy or a similar water-tight sealant. The epoxy forms a fluid-tight seal that safeguards the contents of the hydrotherapy tub. In one preferred embodiment, the epoxy affixes the device 10 in a position that extends through part of the tub inner surface. The body, epoxy, and chamber cooperate to further provide a safe housing for the secure fastening of inlets 12 and 14 to respective fluid supply conduits. The fluid flow device 10 may be affixed in recess of tub inner surface 40.

In one embodiment, the various components, layers, or parts of fluid-flow device 10 are molded of ABS plastic. As one example, any number of parts of the coplanar-flow device may be injection-molded. For instance, any number of the parts of the fluid-flow device may be unitary and/or integral. In one example, inlets 12 and 14 and/or sidewalls 50 with threads 52 may be unitary and/or integral with body 10, such as may be done by injection molding. As another example, one may selectively secure the device parts by techniques such as heating or gluing. For instance, layers/plates/portions could be heated along certain interfaces.

A hydrotherapy tub may be equipped with multiple cooperating instances of hydrotherapy-tub fluid-flow devices (e.g. such as device 10), in accordance with the present invention. As mentioned above, the slotted outlet 28 of nozzle 24 (FIG. 1) advantageously provides substantially coplanar flow relative to the local inner surface 40, as well as selective directional flow as desired by a user. Moreover, the locations of the nozzles participate with local contours of the inner surface to deliver hydrotherapy to the user.

For instance, several of the fluid-flow devices may be positioned in parallel in order to advantageously provide the coplanar flow in the form of overall sheets of injected fluid, as well as directional flow in one or multiple directions as selected by the user. The tub contours already anticipate and promote desirable postures of users in seated and reclined positions. The fluid-flow devices further promote hydrotherapy by extending the coplanar flow between the tub inner surface 40 and along the outer skin of the user for massaging, as well as in another user selected direction to aid in hydrotherapy of additional body areas.

While part(s) of the description herein, for explanatory purposes, may imply certain exemplary direction(s), such direction(s) may be considered relative. For example, by changing the angle of inner wall 34 of nozzle 24, the direction of the fluid flow will vary, and by having a substantially parallel set of inner walls a generally straight fluid flow will result. Therefore by using different nozzles with differing angles the user may customize the directional fluid flow to suit their particular hydrotherapy needs. Design choice(s) allow accommodation(s) of any orientation(s) for any device(s) in accordance with the principles of the present invention.

Numerous alternative embodiments of the present invention exist. For instance, threaded interconnections could easily mount fluid flow device 10 on inner surface 40, fasten inlets 12, 14 to fluid supply conduits, or interconnect nozzle 24 to fluid flow device 10. Further, the fluids could easily be liquid or gas. Moreover, each fluid could easily include a group of fluids. Also, more than two fluids could easily be merged into substantially coplanar flow. For example, chambers 16 and 18 could easily take on any variety of interrelationships, ranging from maximal to minimal fluid intermixing or other combination. Additionally, any number of the devices (e.g., device 10) could easily be secured by mechanisms such as sidewalls 50 with mating threads 52 and a nut. Furthermore, device 10 could easily be fixed in any desired direction relative to a given incline of the inner surface 40.

Figure 8:
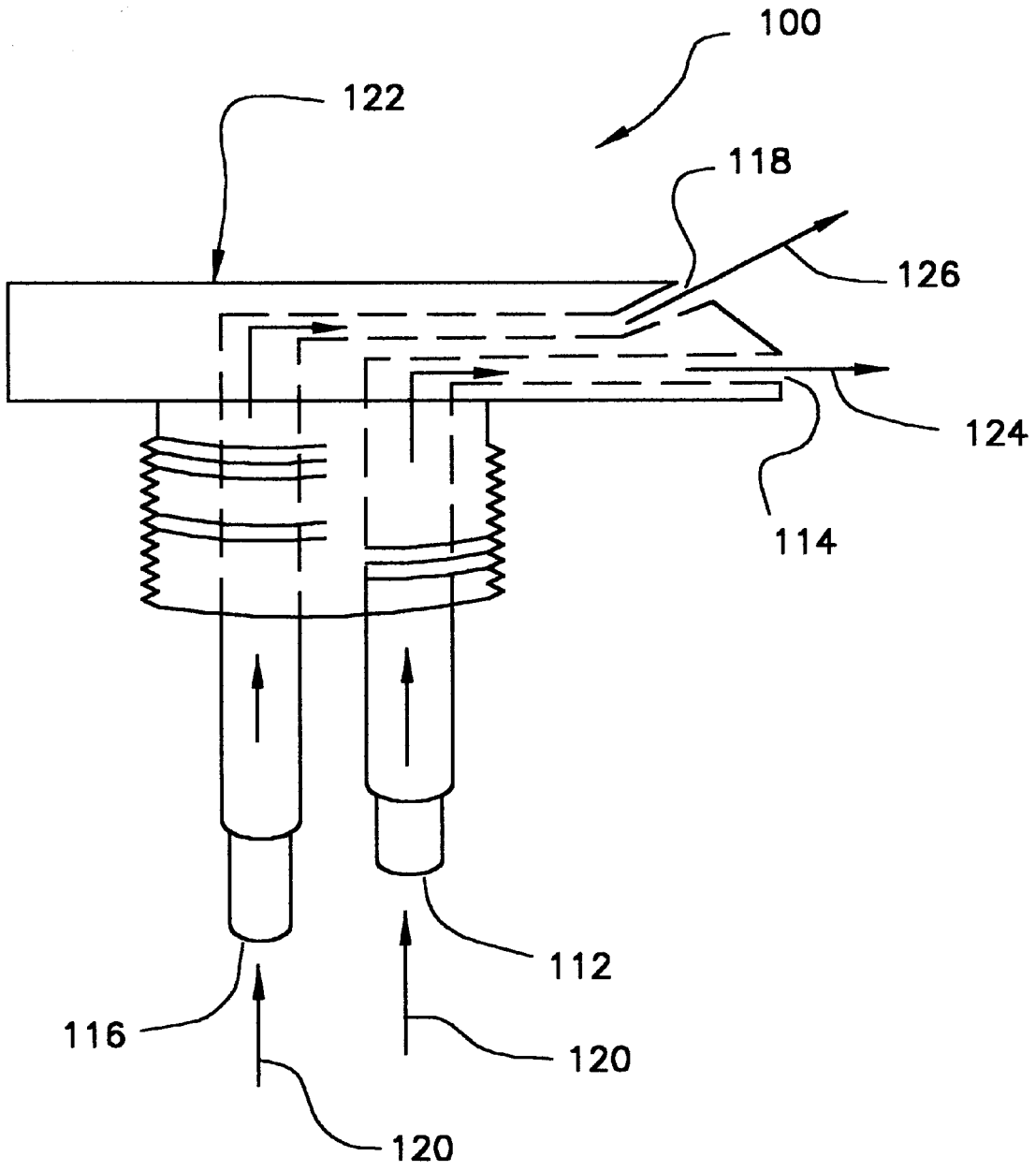
FIG. 8 is a side elevational view of an alternate embodiment of a hydrotherapy-tub two slot fluid-flow device.

FIG. 8 illustrates at fluid flow device 100 configured for multiple slot fluid flow. Device 100 comprises a first fluid inlet 112 fluidly connected to a first fluid outlet 114. Similarly a second fluid inlet 116 is in fluid flow communication with a second fluid outlet 118. Device 100 may be connected to fluid supply conduits and installed on an inner wall of a hydrotherapy to in similar manner as described above. As fluid enters in the direction of arrows 120 it is directed through body 122 and exits in the direction of arrows 124 and 126. In this configuration fluid is directed to flow in a substantially coplanar flow, as indicated by arrow 124, as well as in a selected directional flow as indicated by arrow 126. It will be appreciated by those skilled in the art that the fluid flow configuration of device 100 may be changed to provide directional flow in multiple directions and multiple configurations.

Figure 9:
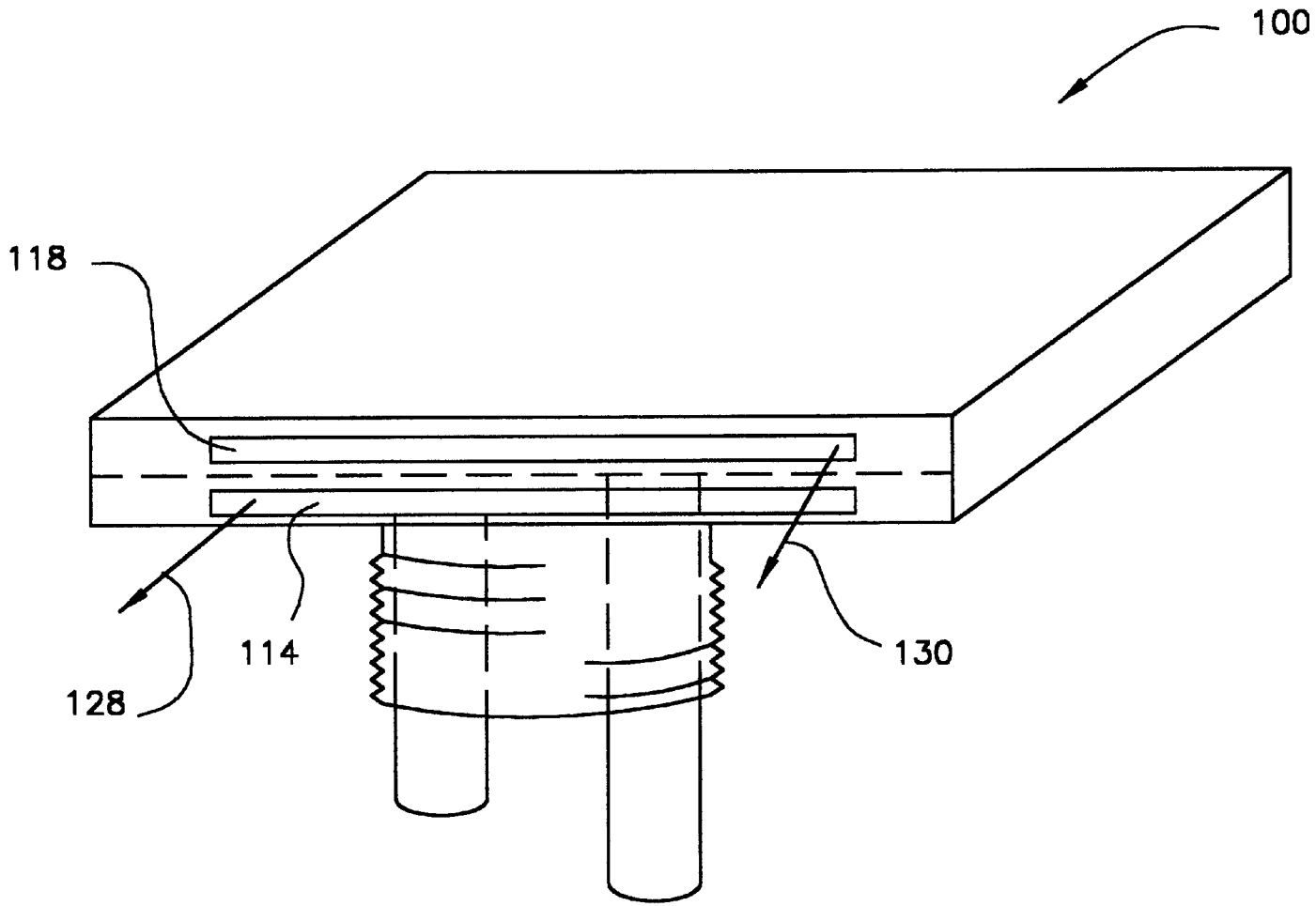
FIG. 9 is a perspective view of an alternate embodiment of a hydrotherapy-tub two slot fluid-flow device.

As shown in FIG. 9, a fluid may be directed to exit fluid outlet 114 in a substantially coplanar flow as indicated by arrow 128, while a second fluid may be directed to exit fluid outlet 118 in a substantially coplanar flow as indicated by arrow 130.

Figure 10:
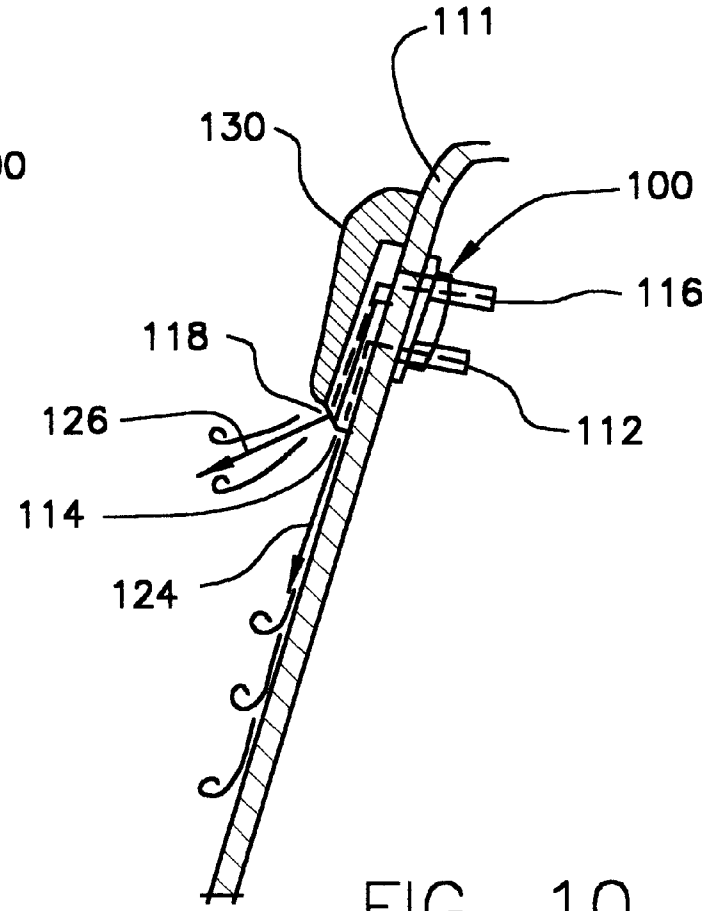
FIG. 10 is a side elevational view of a hydrotherapy-tub two slot fluid-flow device mounted on a hydrotherapy tub.

FIG. 10 illustrates a fluid flow device 100 installed on the inner wall 111 of a hydrotherapy tub. As illustrated, fluid flow device 100 is configured to produce a fluid flow in a first direction, as indicated by arrow 124, as well as producing a fluid flow in a second direction as indicated by arrow 126. In this embodiment fluid flow device 100 is mounted below a head rest 130, this allows a user to direct fluid flow on to be back and neck areas simultaneously.

Figure 11:
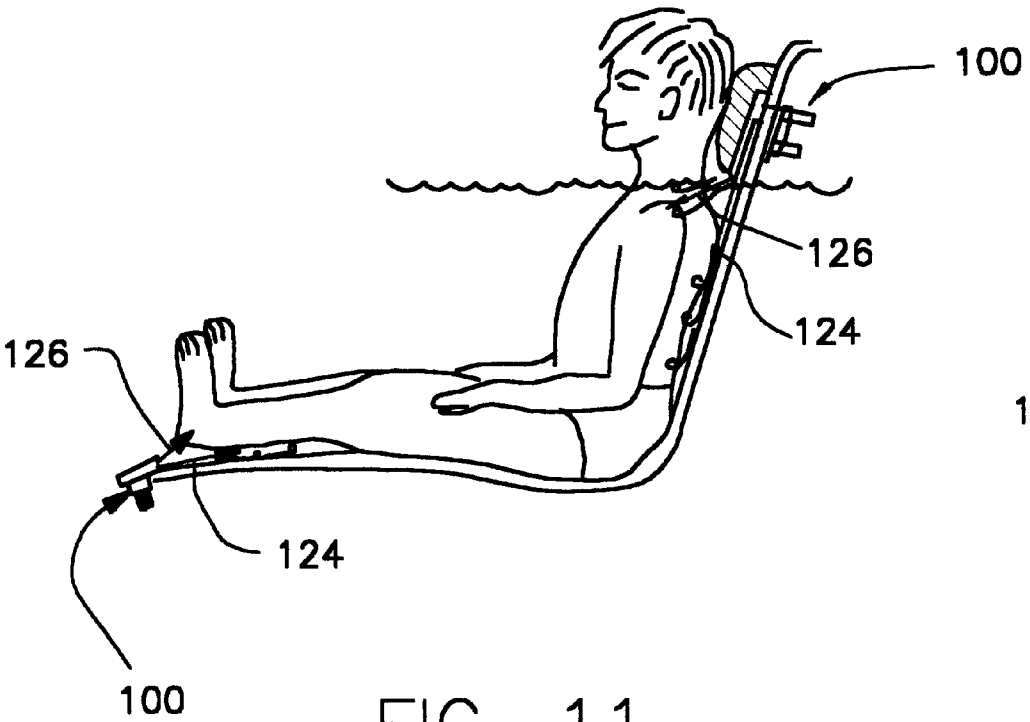
FIG. 11 is a side elevational view of multiple hydrotherapy-tub two slot fluid-flow devices mounted on a hydrotherapy tub and directing fluid flow on a user.

As shown in FIG. 11, fluid-flow devices may advantageously deliver fluid flow, from a first outlet, between the shoulder blades and down along the back of a user. Also, the user selected directional fluid-flow, from a second outlet may be directed outward onto the neck and/or back of the head of a user. Alternatively, a second fluid flow device positioned by the feet of a user to direct fluid flow upward from the feet and ankles and along the calves of a user. Additionally, one may direct the fluid-flow along the buttocks and hamstrings. Naturally, the coplanar flow will ride along and hug around the exposed skin surfaces of the user, while the selective directional flow may be angled for direct hydrotherapy of a body area of the user. This is fully intended and enhanced, to massage greater extents of key body regions of the user by directing the coplanar flow along the inner surface of a hydrotherapy tub as well as in a selective direction as determined by a user, in accordance with the present invention. Although the exemplary embodiment was configured having two inlets and two outlets, alternative embodiments may have three or more inlets fluidly connected to a plurality of outlets. The inlets may be fed by multiple supply conduits or a single supply conduit which splits into multiple outlets for connection to the inlets.

Although preferred embodiments have been depicted and described in detail herein, it will be apparent to those skilled in the relevant art that various modifications, additions, substitutions and the like can be made without departing from the spirit of the invention and these are therefore considered to be within the scope of the invention as defined in the following claims.

What is claimed is:

1. A hydrotherapy-tub fluid flow device, comprising:

a body adapted for mounting on an inner surface of a hydrotherapy tub and attachable to first and second fluid supply conduits, said body having a first inlet for flow of a fluid from said first fluid supply conduit, a second inlet for flow of a fluid from said second fluid supply conduit;

a first outlet for discharge of said first fluid in a first direction wherein said first direction is substantially coplanar to said inner surface of said hydrotherapy tub; and a second outlet for discharge of said second fluid in a second direction.

2. A device as in claim 1, wherein said first outlet comprises a nozzle.

3. A device as in claim 2, wherein said nozzle is removable from said body.

4. A device as in claim 2, wherein said nozzle directs said first fluid in said first direction.

5. A device as in claim 4, wherein said first direction is selected by a user.

6. A hydrotherapy tub, comprising:

an inner surface; and at least one fluid flow device, comprising:

a nobody mounted on said inner surface and attachable to first and second fluid supply conduits, said nobody having a first inlet for flow of a fluid from said first fluid supply conduit , a second inlet for flow of a fluid from said second fluid supply conduit;

a first outlet for discharge of said first fluid in a first direction substantially coplanar to said inner surface; and a second outlet for discharge of said second fluid in a second direction.

7. A device as in claim 6,wherein said first outlet comprises a nozzle.

8. A device as in claim 7, wherein said nozzle is removable from said body.

* * * * *

UNITED STATES PATENT AND TRADEMARK OFFICE

CERTIFICATE OF CORRECTION

PATENT NO. : 6,182,303 B1
DATED : February 6, 2001
INVENTOR(S) : Gardenier et al.

It is certified that error appears in the above-identified patent and that said Letters Patent is hereby corrected as shown below:

Column 8,
Line 8, delete "nobody" and insert -- body --
Line 9, delete "nobody" and insert -- body --

Signed and Sealed this

Sixth Day of November, 2001

*Attest:*

Nicholas P. Godici

NICHOLAS P. GODICI
*Acting Director of the United States Patent and Trademark Office*

*Attesting Officer*